US009004666B2

(12) United States Patent
Uyama

(10) Patent No.: US 9,004,666 B2
(45) Date of Patent: Apr. 14, 2015

(54) PROCESS FOR PRODUCING SUBSTRATE AND SUBSTRATE PROCESSING METHOD

(75) Inventor: Masaya Uyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 298 days.

(21) Appl. No.: 13/271,279

(22) Filed: Oct. 12, 2011

(65) Prior Publication Data

US 2012/0113200 A1 May 10, 2012

(30) Foreign Application Priority Data

Nov. 5, 2010 (JP) ..... 2010-248547

(51) Int. Cl.
*B41J 2/01* (2006.01)
*B41J 2/16* (2006.01)

(52) U.S. Cl.
CPC ..... *B41J 2/1603* (2013.01); *B41J 2/1628* (2013.01); *B41J 2/1629* (2013.01); *B41J 2/1631* (2013.01); *B41J 2/1632* (2013.01)

(58) Field of Classification Search
CPC ..... B41J 2/01
USPC ..... 347/102, 45
See application file for complete search history.

(56) References Cited

U.S. PATENT DOCUMENTS 4,688,053 A * 8/1987 Noguchi et al. ..... 347/65
5,700,316 A * 12/1997 Pontes et al. ..... 106/31.58
6,050,184 A * 4/2000 Kidoura et al. ..... 101/128.4
6,109,737 A * 8/2000 Kishima ..... 347/70
6,375,313 B1 * 4/2002 Adavikolanu et al. ..... 347/63
6,473,966 B1 11/2002 Kohno et al.
7,146,910 B2 * 12/2006 Hasei ..... 101/485
7,837,300 B2 11/2010 Mori
2002/0118255 A1 * 8/2002 Kanri ..... 347/56
2003/0132990 A1 * 7/2003 Mitani ..... 347/63
2003/0218646 A1 * 11/2003 Usuda et al. ..... 347/9
2007/0017894 A1 1/2007 Murayama et al.
2007/0182777 A1 * 8/2007 Vaeth et al. ..... 347/20
2009/0139891 A1 6/2009 Oshima et al.
2009/0183766 A1 7/2009 Takahashi et al.
2009/0212008 A1 8/2009 Uyama et al.
2009/0244198 A1 * 10/2009 Hayakawa et al. ..... 347/63
2010/0245478 A1 * 9/2010 Uno ..... 347/47
2012/0076468 A1 3/2012 Makino et al.

FOREIGN PATENT DOCUMENTS

DE 60020308 T2 11/2005
EP 1 075 390 B1 5/2005

(Continued)

OTHER PUBLICATIONS

Office Action in German Application No. 102011117498.6 (Feb. 13, 2014).

*Primary Examiner* — Alessandro Amari
*Assistant Examiner* — Alexander C Witkowski
(74) *Attorney, Agent, or Firm* — Fitzpatrick, Cella, Harper & Scinto

(57) ABSTRACT

The invention provides a process for producing a protective-layer-provided substrate in which a protective layer is formed on a substrate on the surface of which a plurality of structures have been arranged at intervals. The protective layer has a resin layer and a film for chucking. The process includes the steps of forming the resin layer between the respective structures, on the surfaces of the respective structures and on the surface of the substrate having the plurality of the structures; and forming the film for chucking on the resin layer to form the protective layer.

15 Claims, 3 Drawing Sheets

(56) References Cited

FOREIGN PATENT DOCUMENTS

| | | | |
|---|---|---|---|
| JP | 2002-234168 | A | 8/2002 |
| JP | 2002-326361 | A | 11/2002 |
| JP | 2002-368071 | A | 12/2002 |
| JP | 2009-233939 | A | 10/2009 |
| KR | 10-2008-0081361 | A | 9/2008 |
| WO | 2010/126116 | A1 | 11/2010 |

* cited by examiner

PROCESS FOR PRODUCING SUBSTRATE AND SUBSTRATE PROCESSING METHOD

BACKGROUND OF THE INVENTION

1. Field of the Invention

The present invention relates to a process for producing a protective-layer-provided substrate by forming a protective layer on a substrate on the surface of which a plurality of structures have been arranged at intervals, and a substrate processing method using the protective-layer-provided substrate.

2. Description of the Related Art

In an ink jet recording apparatus, minute ink droplets are ejected from plural ink ejection orifices arranged in an ink jet head to record an image.

In general, as an ink jet substrate, is used a substrate obtained by forming an ink supply port extending thorough front and back surfaces in a single crystal silicon substrate (hereinafter also referred to as "silicon substrate" merely) cut in the direction of <100> crystal orientation. An ink flows through an ink flow path formed on the ink jet substrate from the ink supply port and flows into an ink chamber in which a pressure-generating element has been formed. An ejection pressure is generated by the pressure-generating element, whereby the ink is flown out of an ink ejection orifice formed in the ink chamber to conduct printing. Incidentally, a member forming a pattern of these ink flow path, ink chamber and ink ejection orifice is generally referred to as an ink jet structure for the sake of convenience. The ink jet structure may be formed of one member or a plurality of members.

The timing of forming the ink supply ports is roughly divided into 2 methods. One is a method of forming an ink jet structure after forming an ink supply port, and the other is a method of forming an ink supply port after forming an ink jet structure. The latter method is required to work and form the ink supply port from the back surface of the substrate because the ink jet structure formed on the front surface of the substrate becomes hindrance.

As methods for forming ink supply ports, have been proposed various methods such as wet etching and laser beam machining. One of such methods is a method of forming it with dry etching. The formation of the ink supply port with the dry etching is required to fix the front surface of the substrate, on which the ink jet structures have been formed, by electrostatic chucking.

However, the surface of the ink jet structure is generally not flat and has projected or dented portions or has unevenness, and a plurality of such ink jet structures may be arranged on a substrate at intervals in some cases. Thus, it may be difficult in some cases to stably fix the ink jet structures by the electrostatic chucking because the ink jet structures themselves each have a large bump or there are voids between the ink jet structures. Incidentally, the thickness of the ink jet structure is known to be generally of the order of 5 to 100 μm.

When the ink jet structure is formed of a material having no conductivity (for example, a resin material), the electrostatic chucking itself may be difficult in some cases because such a material is low in dielectric constant. On the other hand, the electrode voltage upon the electrostatic chucking is set high, whereby chucking becomes feasible. As a result, however, a power source for electrostatic chucking becomes large-sized because a high voltage is required, and discharge may be caused with respect to its surrounding portions in some cases.

Under such circumstances, Japanese Patent Application Laid-Open No. 2002-368071 discloses a structure for easily achieving the electrostatic chucking. Japanese Patent Application Laid-Open No. 2002-368071 describes that a conductive layer (specifically, a conductive film) is formed on a glass substrate difficult to be fixed by electrostatic chucking at low voltages, whereby the substrate can be easily fixed by the electrostatic chucking.

When the technique of Japanese Patent Application Laid-Open No. 2002-368071 is applied to an ink jet substrate on which ink jet structures have been formed, however, the following case may be supposed. More specifically, a void may be present between a film for chucking corresponding to the conductive layer and a bump that the ink jet structure has.

In addition, when a plurality of such ink jet structures are arranged on the surface of a substrate at intervals and a film for chucking is formed, a void may be present between the respective ink jet structures in addition to between the film for chucking and a bump that the ink jet structures each have.

When a substrate 1 on the surface of which a plurality of structures 2 have been arranged at intervals is used as illustrated in FIG. 3, a void 3 may be produced between the respective structures when a film 5 for chucking is formed even when the surface of each structure is a flat surface having no bump. When it is intended to conduct a vacuum process such as dry etching in such a state that such voids are present, the voids may start growing under reduced pressure, resulting in peeling off of the conductive layer (conductive film).

The surface of the ink jet structure is often subjected to a water-repellent treatment, and so the adhesion of the film to the water-repellent surface tends to be more lowered, and the peeling off of the film is liable to occur.

Although the problems on the ink jet substrate have been mentioned above, in substrates on the surfaces of which a plurality of structures have been arranged at intervals, the presence of voids is a common problem.

An object of the present invention is as follows. More specifically, the object is to provide a process for producing a protective-layer-provided substrate that reduces voids produced upon the formation of a film for chucking to reduce the peeling off of the film under reduced pressure and forms smoothness sufficient for stably conducting electrostatic chucking on the surface of the film, and to provide a substrate processing method.

SUMMARY OF THE INVENTION

In the present invention, a protective-layer-provided substrate is fabricated according to the following production process.

More specifically, the process is a process for producing a protective-layer-provided substrate in which a protective layer is formed on a substrate on the surface of which a plurality of structures have been arranged at intervals, the protective layer having a resin layer and a film for chucking, the process including the steps of:

(1) forming the resin layer between the respective structures, on the surfaces of the respective structures and on the surface of the substrate having the plurality of the structures, and (2) forming the film for chucking on the resin layer to form the protective layer.

The present invention also provides a substrate processing method including subjecting the protective-layer-provided substrate to a predetermined treatment at least once in a vacuum chamber.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The form and material of the plurality of the structures arranged on the surface of the substrate used in the present invention may be selected as needed. The surface of each structure may be either uneven or flat, and the form of the plurality of the structures may be different from one another. The structures may have or not have conductivity.

According to the present invention, even when the plurality of the structures are arranged on the surface of the substrate at intervals, the structures have a bump on the surfaces thereof, and a void is present between the respective structures, a resin layer fills the bump portions and the void between the respective structures. Therefore, voids produced upon the formation of the film for chucking can be reduced. As a result, the peeling off of the film for chucking caused by expansion of the voids in a vacuum process such as dry etching that is conducted under reduced pressure can be reduced because the voids are reduced.

In addition, in the present invention, the film for chucking is favorably formed on the resin layer while heating the resin layer to a temperature not lower than the softening point of the resin layer, whereby smoothness sufficient for stably conducting electrostatic chucking can be formed on the surface of the film for chucking.

Embodiments of the present invention will hereinafter be described in detail with reference to the drawings. However, the following embodiments do not limit the scope of the present invention and are provided for sufficiently explaining the present invention to those skilled in the art.

Incidentally, the present invention relates to a process for producing a protective-layer-provided substrate by forming a protective layer on a substrate on the surface of which a plurality of structures have been arranged at intervals, and a substrate processing method using the protective-layer-provided substrate, and the protective layer is formed of a resin layer, which will be described subsequently, and a film for chucking.

Figure 1A:
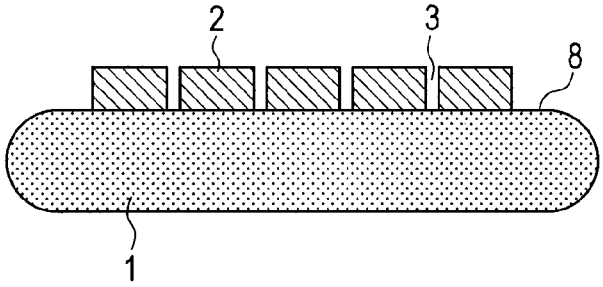
FIGS. 1A, 1B, 1C and 1D are typical sectional views for illustrating respective steps of the production process and substrate processing method according to the present invention.
Figure 1B:
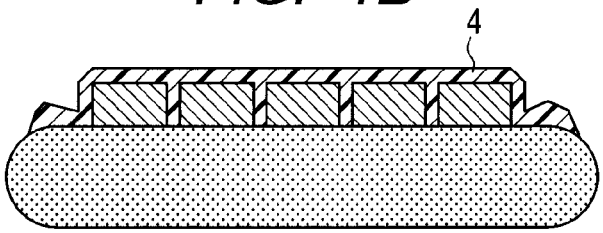
Figure 1C:
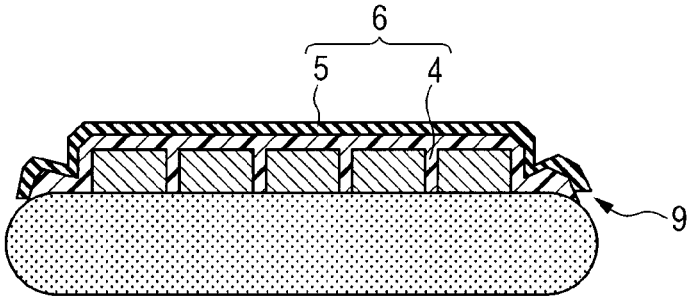
Figure 1D:
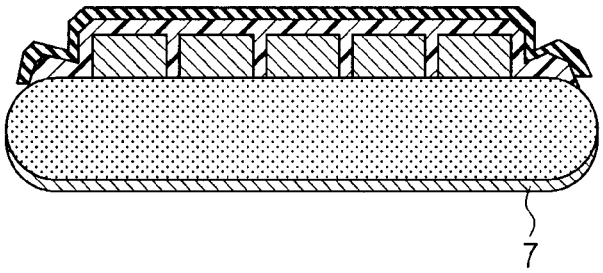

FIGS. 1A to 1C are sectional views illustrating a substrate in the course of the production of the protective-layer-provided substrate according to the present invention, and FIG. 1D is a sectional view illustrating a substrate in the substrate processing method according to the present invention.

FIG. 1A illustrates a substrate 1 on the surface of which a plurality of structures 2 have been formed. The surfaces of the plurality of the structures are flat, the structures are arranged at intervals, and a void 3 is present between the respective structures.

This substrate 1 may be, for example, an ink jet substrate. In this case, at least one pattern among an ink ejection orifice from which ink is ejected, an ink chamber in which an ejection-pressure-generating element for generating energy for ejecting ink has been formed, and an ink flow path for guiding ink to an ink chamber may be formed by the structures 2. In short, the production process and substrate processing method according to the present invention can be applied to an ink jet head composed of ink jet structures and an ink jet substrate.

Incidentally, the ink jet structure is a general name of a member forming a pattern of an ink flow path, an ink chamber and an ink ejection orifice, and the ink jet structure may be formed from one member or a plurality of members.

As illustrated in FIG. 1B, a resin layer 4 is then formed between the respective structures, on the surfaces of the respective structures and on the surface of the substrate having the plurality of the structures (step (1)).

As a method for forming the resin layer, may be used any publicly known method for forming a resin layer on a substrate. However, it is favorable to apply a liquid resin between the respective structures, on the surfaces of the respective structures and on the surface 8 of the substrate having the plurality of the structures by a spin coating method and then bake the resin. The liquid resin is then enters in the void 3 to reduce the void between the structures. Incidentally, the liquid resin is composed of a material of the resin layer, which will be described subsequently, and a solvent for dissolving the material, wherein acetone, methyl ethyl ketone, methyl isobutyl ketone, cyclohexanone, toluene, xylene or cyclohexane may be applied to the solvent.

The viscosity of the liquid resin is favorably 0.2 Pa·s or more and 0.8 Pa·s or less (200 cP or more and 800 cP or less) at 25° C. When the viscosity of the liquid resin is 0.8 Pa·s or less, it can be easily prevented to lower the filling ability in between the respective structures and to form a void between the respective structures. In addition, when the viscosity is 0.2 Pa·s or more, it can be easily prevented that most of the liquid resin flows into the bottom between the structures and that coating of the entire void 3 with the resin layer 4 becomes difficult.

Incidentally, the viscosity is a value measured by means of an E-type viscometer at 25° C.

The material of the resin layer 4 is favorably a thermoplastic resin because the resin layer is favorably softened by heating in a later step, and a resin containing a cyclized rubber as a main material is favorably used. In addition, an acrylic resin or polyimide resin may also be applied. The softening point of the resin layer is favorably 30° C. or more and 100° C. or less though its heat-resisting temperature varies according to surrounding materials, and the softening point is selected from this range, thereby providing easy handling. Such a resin is dissolved in the above-descried solvent, whereby the liquid resin can be prepared.

As illustrated in FIG. 1C, a film 5 for chucking is then formed on the resin layer 4 (step (2)), whereby a protective-layer-provided substrate 9 according to the present invention can be obtained. In this case, it is favorable to form the film for chucking on the resin layer while heating the resin layer to a temperature not lower than the softening point of the resin layer. Two effects are brought about by heating the resin layer to the temperature not lower than the softening point. First, adhesion between the film 5 for chucking and the resin layer 4 can be more improved by laminating the resin layer 4 and the film 5 for chucking on each other in such a state that the resin layer is heated to the temperature not lower than the softening point. Second, the smoothening of the surface of the resin layer can be assisted by laminating the resin layer 4 and the film 5 for chucking on each other in such a state that the resin layer is heated to the temperature not lower than the softening point.

The heating temperature varies according to the resin layer used. For example, when a cyclized-rubber-based resin the softening point of which is adjusted to 40° C. is used as the resin layer, the lamination is conducted at about 80° C., whereby the adhesion between the resin layer 4 and the film 5 for chucking and the smoothness can be easily made good. Incidentally, the protective layer 6 is formed of the resin layer 4 and the film 5 for chucking as described above.

When the film 5 for chucking is formed on the resin layer 4, the film 5 for chucking may be laminated on the resin layer 4 under reduced pressure, whereby microvoids formed upon the lamination of the resin layer 4 and the film 5 for chucking can be easily minimized to still more reduce peeling off of the film 5 for chucking in the vacuum process such as dry etching.

Incidentally, the film 5 for chucking may be a conductive film having conductivity. The film for chucking has conductivity, whereby the film itself may be polarized at a low voltage upon electrostatic chucking in a later step to easily conduct the electrostatic chucking. As the conductive film, is favorably used that obtained by forming a conductive polymer or ITO (indium tin oxide) into a desired base material. In short, the conductive film is favorably either a conductive polymer film or an ITO film. As the base material used in the conductive film, may be used, for example, a polyethylene naphthalate resin (PEN resin) or a polyimide resin.

The protective-layer-provide substrate 9 obtained by the above-described process is then subjected to a predetermined treatment at least once in a vacuum chamber. As examples of the predetermined treatment (vacuum process) in the vacuum chamber, may be mentioned dry etching and vacuum film formation. Even when these vacuum processes are conducted, the occurrence of peeling off of the film for chucking can be reduced in the present invention to conduct electrostatic chucking. Incidentally, in FIG. 1D, vacuum film formation is conducted as the predetermined treatment in the vacuum chamber to form a film 7 on a surface opposite to the surface having the protective layer in the substrate.

An experimental example in which the influence on the smoothness of the surface of a substrate when a resin layer and a film for chucking were laminated in such a state that the resin layer was heated to form a protective layer on the surface of the substrate where ink jet structures had been formed was studied is described below. Specifically, three materials for resin layer that are different in softening point were each used to form a resin layer to compare a case where a film for chucking was laminated on the resin layer without heating the resin layer with a case where a film for chucking was laminated on the resin layer while heating the resin layer to 80° C.

Incidentally, a bump formed by an ink jet structure (thickness of the ink jet structure) used in the experiment was 50 μm. The evaluation on the smoothness was made by measuring a surface height at many points by means of a non-contact three-dimensional measuring device (manufactured by Mitaka Kohki Co., Ltd., trade name: NH-3N) to make evaluation with a difference between a maximum vale and a minimum value among the measuring points. Incidentally, the evaluation criteria are as follows:

AA: Smoothness was greatly improved (difference between the maximum vale and the minimum value was less than 10 μm);

A: Smoothness was improved (difference between the maximum vale and the minimum value was 10 μm or more and less than 40 μm);

B: Smoothness was scarcely improved (difference between the maximum vale and the minimum value was 40 μm or more).

TABLE 1

| Material of resin layer | Softening point | Smoothness | |
|---|---|---|---|
| | | Not heated | Heated |
| Cyclized-rubber-based resin | About 40° C. | B | AA |
| Wax-based resin | About 70° C. | B | A |
| Polyester resin | About 140° C. | B | B |

From Table 1, the smoothness was not varied by heating in the polyester resin material the softening point of which was higher than 80° C. that was a laminating temperature (resin layer heating temperature). On the other hand, the smoothness was improved by laminating the film for chucking while heating the resin layer to 80° C. in the cyclized-rubber-based resin and wax-based resin the softening points of which were lower than the laminating temperature. In particular, in the cyclized-rubber-based resin the softening point of which was about 40° C., the smoothness was greatly improved. The improvement in smoothness is attributable to the situation that the resin layer is heated to the temperature not lower than the softening point of the resin layer, whereby flowability is imparted to the resin layer to more improve the smoothening effect upon the lamination of the film for chucking.

As an embodiment, a process for producing an ink jet substrate 10 on the surface of which a plurality of ink jet structures 20 have been arranged at intervals will herein after be described in more detail according to steps illustrated in FIGS. 2A to 2G.

A single crystal silicon wafer that had a substrate thickness of 300 μm and was produced with a <100> ingot drawing direction was provided as a substrate 11.

Figure 2A:
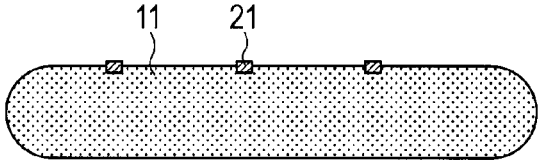
FIGS. 2A, 2B, 2C, 2D, 2E, 2F and 2G are sectional views for illustrating an embodiment of the production process and substrate processing method according to the present invention.

As illustrated in FIG. 2A, a silicon oxide film (film thickness: about 1 μm (about 10,000 Å)) was then formed on one surface of the substrate by thermal oxidation, and a pressure-generating elements 21 and a drive circuit for driving the element were formed by means of a commonly used semiconductor process. In addition, a silicon nitride film was formed by PECVD (plasma-enhanced chemical vapor deposition) for insulating and protecting the pressure-generating element 21 and the drive circuit from ink.

At this time, the film was formed in a film thickness of about 0.3 μm (about 3,000 Å). Incidentally, these films are very thin in the light of the scale of the figure, and so only the pressure-generating element 21 is illustrated. In addition, the side of the substrate on which these films were formed is regarded as a front side, and the side opposite to this side is regarded as a back side.

Figure 2B:
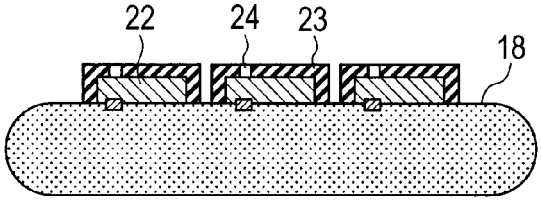

As illustrated in FIG. 2B, the following treatments were conducted on the front side of the substrate. First, a positive resist (product of TOKYO OHKA KOGYO CO., LTD., trade name: ODUR) containing poly(methyl isopropenyl ketone) as a main material, which can be dissolved out by a treatment described below and will become a pattern 22 of an ink flow path and an ink chamber, was applied by spin-coating.

The resist was then exposed to deep-UV light and developed to form a desired pattern. The pattern 22 of the flow path and chamber also serves as an etch-stop layer upon etching described below. In addition, a cationically polymerized epoxy resin which will become an orifice plate 23 was applied by spin-coating on the pattern 22 to form an ink ejection orifice 24 through exposure and development, thereby forming a substrate on which a plurality of substrates had been arranged at intervals.

A liquid resin (product of TOKYO OHKA KOGYO CO., LTD., trade name: OBC) containing a cyclized rubber having a softening point of about 40° C. as a main material was then applied on the substrate on which the orifice plate 23 had been formed. More specifically, the liquid resin was applied between the respective structures, on the surfaces of the respective structures and on the surface 18 of the substrate having the plurality of the structures. Incidentally, the liquid resin was adjusted with xylene before use in such a manner that the viscosity thereof is 0.5 Pa·s (500 cP) at 25° C., and a spin coating method was used as the coating method.

Figure 2C:
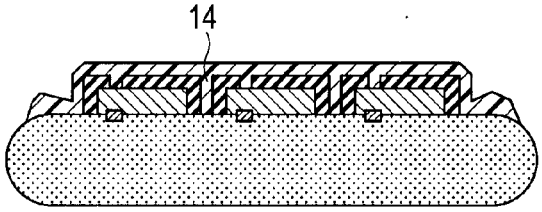

Thereafter, the liquid resin was baked at 120° C. to vaporize the solvent in the liquid resin, thereby forming a resin layer 14 (step (1), FIG. 2C). Incidentally, an E-type viscometer (manufactured by TOKI SANGYO CO., LTD., trade name: TV-22 Type Viscometer Cone Plate Type) was used to measure the viscosity at 25° C.

Figure 2D:
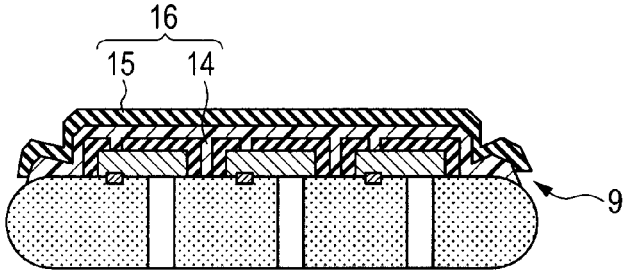

A film 15 for chucking was then formed on the resin layer 14 while heating the resin layer (step (2)). As the film 15 for chucking, was used a conductive film (product of Achilles Corporation, trade name: ST Chucking Film) on the surface of which a conductive polymer had been arranged. As a base material of the conductive film, was used a PEN resin formed into a thickness of 40 μm. The heating temperature of the resin layer was set to 70° C., and a vacuum laminator (manufactured by Takatori Corporation, trade name: TEAM-100) was used as a forming device. A protective-layer-provided substrate 19 having a protective layer 16 formed from the resin layer 14 and the film 15 for chucking was thereby formed (FIG. 2D).

A positive resist 25 (product of TOKYO OHKA KOGYO CO., LTD., trade name: OFPR) was then applied on a back surface of the substrate and patterned to form a mask. Dry etching was conducted by means of an ICP (inductively coupled plasma) etching device until the silicon oxide film formed on the front surface of the substrate was reached from the back surface of the substrate to form an ink supply ports 26.

Figure 2E:
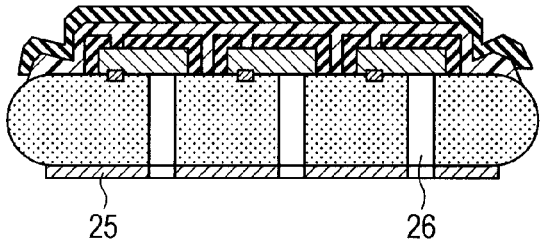
Figure 3:
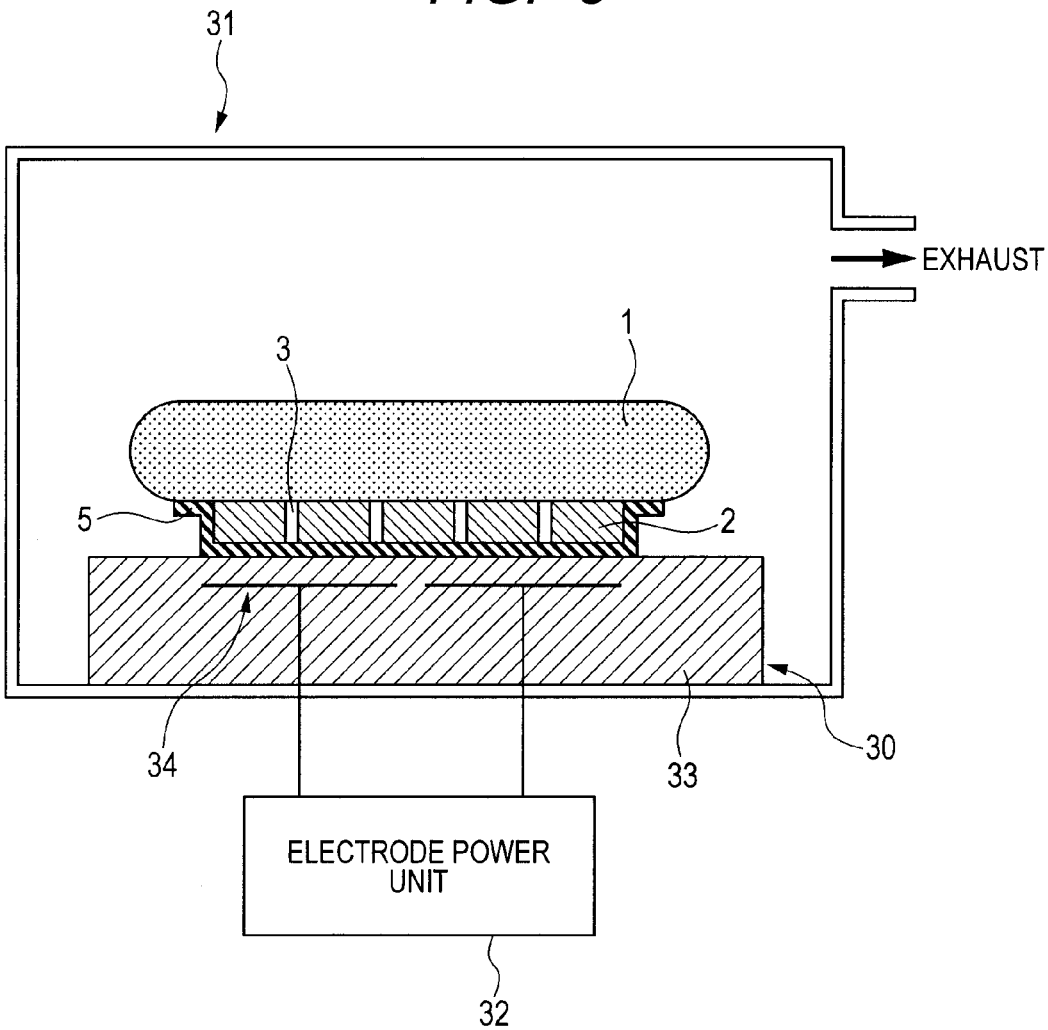
FIG. 3 is a typical sectional view for illustrating a treatment in a vacuum chamber using a substrate having a film for chucking as formed by a prior art technique.

Thereafter, the silicon oxide film and silicon nitride film were removed by RIE (reactive ion etching) through openings of the ink supply port 26. Incidentally, electrostatic chucking could be stably conducted without causing peeling off of the film 15 for chucking even through these vacuum processes, i.e., dry etching that is a treatment step in a vacuum chamber (FIG. 2E). Incidentally, as illustrated in FIG. 3, the dry etching was conducted by means of an apparatus equipped with an electrostatic chucking device 30, an electrode power unit 32, a chuck plate 33 and electrodes 34 in a vacuum chamber 31.

Figure 2F:
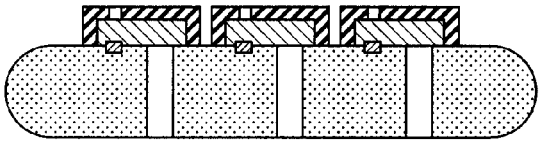

After the positive resist 25 was then removed, the film 15 for chucking was peeled off while heating to 80° C., and the resin layer 14 was dissolved with xylene, thereby separating the protective layer 16 (FIG. 2F).

Figure 2G:
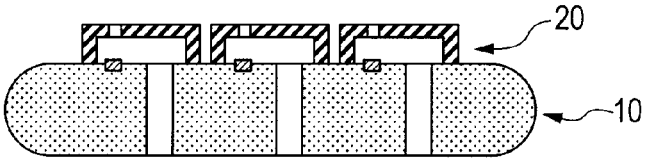

Thereafter, the ink flow path pattern 22 was exposed by irradiation with UV light from above the orifice plate, and the substrate was immersed in methyl lactate, thereby dissolving out the pattern. Finally, the substrate was sufficiently washed with water and dried to obtain an ink jet head composed of the ink jet structures 20 and the ink jet substrate 10 as illustrated in FIG. 2G.

The production process and substrate processing method according to the present invention can be applied to an ink jet head installed in an ink jet recording apparatus that records an image by ejecting minute droplets of an ink having a predetermined hue at desired positions of a recording paper.

According to the present invention, there are provided a process for producing a protective-layer-provided substrate that reduces voids produced upon the formation of a film for chucking to reduce the peeling off of the film under reduced pressure and forms smoothness sufficient for stably conducting electrostatic chucking on the surface of the film, and provided a substrate processing method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-248547, filed Nov. 5, 2011, which is hereby incorporated by reference herein in its entirety.

What is claimed is:

1. A process for producing a treated substrate by using a protective layer, the process comprising, in stated order (1)-(4):

(1) providing a substrate having on a surface thereof a plurality of respective structures protruding from the surface and arranged at intervals;

(2) forming a resin layer (i) to fill a gap between the respective structures, (ii) on surfaces of the respective structures, and (iii) on the surface of the substrate on which the plurality of the structures are arranged;

(3) forming a film for chucking on the resin layer to form the protective layer, where the protective layer comprises the resin layer and the film; and (4) subjecting the substrate on which the film has been formed to a vacuum process.

2. The production process according to claim 1, wherein the respective structures form at least one pattern among an ink flow path through which an ink flows, an ink chamber in which an ejection-pressure-generating element for generating energy for ejecting the ink is formed, and an ink ejection orifice from which an ink is ejected.

3. The production process according to claim 1, wherein in the step (2), a liquid resin is applied between the respective structures, on the surfaces of the respective structures and on the surface of the substrate having the plurality of the structures by a spin coating method and then baked to form the resin layer.

4. The production process according to claim 3, wherein the viscosity of the liquid resin is 0.2 Pa·s or more and 0.8 Pa·s or less at 25° C.

5. The production process according to claim 1, wherein the resin layer comprises a thermoplastic resin.

6. The production process according to claim 1, wherein in the step (3), the film for chucking is formed on the resin layer while heating the resin layer to a temperature not lower than the softening point of the resin layer.

7. The production process according to claim 1, wherein the softening point of the resin layer is 30° C. or more and 100° C. or less.

8. The production process according to claim 1, wherein the resin layer comprises a cyclized rubber as a main material.

9. The production process according to claim 1, wherein in the step (3), the film for chucking is laminated under reduced pressure.

10. The production process according to claim 1, wherein the film for chucking is a conductive film.

11. The production process according to claim 10, wherein the conductive film is a conductive polymer film.

12. The production process according to claim 10, wherein the conductive film is an ITO film.

13. The production process according to claim 1, wherein the vacuum process comprises dry etching.

14. The production process according to claim 1, wherein the vacuum process comprises vacuum film formation.

15. The production process according to claim 1, wherein the film for chucking is formed so as to cover a side of the substrate.

* * * * *